US012188219B1

(12) United States Patent
Quintal

(10) Patent No.: US 12,188,219 B1
(45) Date of Patent: Jan. 7, 2025

(54) PORTABLE RESTROOM SYSTEM AND A NOISE-REDUCING AND LESS LABOR-INTENSIVE METHOD FOR DRAINING PORTABLE RESTROOMS

(71) Applicant: Clean Restroom Rentals, Inc., Westborough, MA (US)

(72) Inventor: Stephen Quintal, Haverhill, MA (US)

(73) Assignee: Clean Restroom Rentals, Inc., Westborough, MA (US)

( * ) Notice: Subject to any disclaimer, the term of this patent is extended or adjusted under 35 U.S.C. 154(b) by 0 days.

(21) Appl. No.: 18/671,126

(22) Filed: May 22, 2024

Related U.S. Application Data

(60) Provisional application No. 63/626,631, filed on Jan. 30, 2024.

(51) Int. Cl.
*E03F 7/10* (2006.01)
*A47K 11/02* (2006.01)

(52) U.S. Cl.
CPC ..... *E03F 7/10* (2013.01); *A47K 11/02* (2013.01)

(58) Field of Classification Search
CPC ..... E03F 7/10; A47K 11/02
USPC ..... 4/461
See application file for complete search history.

(56) References Cited

U.S. PATENT DOCUMENTS 2,065,523 A * 12/1936 Groeniger ..... E03C 1/122 285/125.1
3,651,524 A * 3/1972 Bengtsson ..... E03C 1/22 4/211
3,853,140 A * 12/1974 Gorman ..... E03C 1/122 137/357
6,092,549 A * 7/2000 Eriksson ..... E03C 1/122 137/340
6,997,204 B2 2/2006 Sansom et al.
7,124,769 B2 10/2006 Sansom et al.
2017/0196418 A1* 7/2017 Ito ..... E04H 1/1216
2019/0063978 A1* 2/2019 Brodbeck ..... E03F 7/10

* cited by examiner

*Primary Examiner* — Huyen D Le
(74) *Attorney, Agent, or Firm* — Bulkley, Richardson and Gelinas, LLP; Mary R. Bonzagni, Esq.

(57) ABSTRACT

A portable restroom system for use in a multilevel building under construction, a noise-reducing and less labor-intensive method for draining the portable restrooms in the inventive system, and a method of remotely controlling the power take-off (PTO) mechanism of a sanitation truck, which powers the truck's vacuum system, are provided. A notable advantage of the present invention is that it allows for the PTO of a sanitation truck to be controlled remotely. This allows the truck's vacuum system to be operated intermittently or only as needed, thereby limiting the high levels of noise from the exhaust airflow, which is disruptive to areas adjacent to the construction site. Another notable advantage of the present invention is that it obviates the need to transport each portable restroom down to a ground level or floor of the building under construction for service (e.g., drainage and cleaning/sanitizing), which saves both time and labor.

10 Claims, 3 Drawing Sheets

PORTABLE RESTROOM SYSTEM AND A NOISE-REDUCING AND LESS LABOR-INTENSIVE METHOD FOR DRAINING PORTABLE RESTROOMS

CROSS-REFERENCE TO RELATED APPLICATION

This application claims the benefit of priority of U.S. Provisional Patent Application Ser. No. 63/626,631, filed on Jan. 30, 2024, the contents of which are herein incorporated by reference.

BACKGROUND OF THE INVENTION

Generally, disposal of human waste in construction sites is conducted by locating portable toilets or restrooms on at least the ground level of a building under construction. In a multi-level building under construction, such as high-rise buildings or the like, portable restrooms may also be placed on above-ground floor levels. Placement on above-ground floor levels ensures that workers at different heights have convenient and efficient access to restroom facilities.

For sanitary and health reasons, and because the holding tank is not connected to a sewage system, a typical portable restroom installed on a construction site must be drained and sanitized on a regular basis. This can be challenging, if not impossible, on some sites, such as high-rise buildings, and for this reason, portable restrooms are typically brought down by construction or service elevators to a ground level of the construction site for service. Unfortunately, this process is both labor intensive and time consuming. Further, vehicles (e.g., sanitation trucks) that remove semi-solid or liquid waste from portable restrooms with suction generated by a blower, which often requires the engine to operate at a higher speed, produce high levels of noise from exhaust airflow, which is disruptive to both business and residential areas adjacent to the construction site.

It is an object of the present invention to address the above-referenced drawbacks.

SUMMARY OF THE INVENTION

The present invention therefore provides a portable restroom system for use in a multilevel building under construction, which comprises: a plurality of portable restrooms; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection located on each level or floor of the building with one or more portable restrooms, wherein the pipe also has a plumbing connection on a ground or lower floor level of the building allowing for fluid access to a vacuum system of a sanitation truck having a power take-off device (PTO), wherein the vacuum system is powered by the truck's PTO.

The term "portable toilet" or "portable restroom", as used herein, shall mean a room having at least one sanitary fixture (e.g., a toilet, a urinal), at least one holding or septic tank, and optionally, one or more plumbing connections.

The plurality of portable restrooms in the inventive portable restroom system may be placed on any floor of the building under construction, as desired. In some embodiments, for example, one or more portable restrooms may be located on each floor, or on alternating floors, or on every fourth floor.

In an exemplary embodiment of the inventive system, each portable restroom is capable of being lifted to an above-ground-level floor of a building under construction with at least one of a crane or a hoist.

In another exemplary embodiment, each portable restroom is either provided with wheels, or is positioned on a wheeled pallet or dolly, allowing it to be easily moved onto and off a construction or service elevator.

In yet another exemplary embodiment, the multilevel building under construction has more than ten floors, and the substantially vertically extending pipe located at or above the tenth floor has:

(a) one or more reduced diameter sections; and/or (b) one or more power booster sub-stations positioned along and in fluid communication with the pipe.

The present invention further provides a noise-reducing and less labor-intensive method for draining the plurality of portable restrooms in the inventive system described above, the method comprising:

fluidly connecting a vacuum-like hose from the sanitation truck to the pipe's ground or lower floor level plumbing connection; and in succession on each floor of the building containing the one or more portable restrooms:

(a) opening the pipe's plumbing connection (e.g., dump valve assembly);

(b) fluidly connecting the pipe to a portable restroom;

(c) remotely starting the vacuum system of the sanitation truck;

(d) removing waste from the portable restroom;

(e) remotely stopping the vacuum system of the sanitation truck;

(f) repeating steps (b)-(e) until waste has been removed from each portable restroom on the floor; and then (g) closing the pipe's plumbing connection.

In a preferred embodiment, after closing the pipe's plumbing connection in proximity to the one or more portable restrooms, the method further comprises cleaning the one or more drained portable restrooms.

In one such embodiment, cleaning the one or more drained portable restrooms comprises: using high-pressure water from the water line and a biocidal spray to kill bacteria and microbes to clean out the toilet or urinal, and refilling the at least one holding tank with fresh water from the water line and a chemical deodorizer.

In an exemplary embodiment, the multilevel building under construction has more than ten floors, and the substantially vertically extending pipe located on an upper floor at or above the tenth floor has one or more power booster sub-stations positioned along and in fluid communication with the pipe, each sub-station composed of a fluid pump and a holding tank, the method further comprising:

in succession on each upper floor of the building containing the one or more portable restrooms:

(a) opening the pipe's plumbing connection;

(b) fluidly connecting the pipe to a portable restroom;

(c) remotely starting the fluid pump of the power booster sub-station located on the upper floor;

(d) removing waste from the portable restroom, and directing the waste to the power booster sub-station's holding tank;

(e) remotely stopping the fluid pump of the power booster sub-station;

(f) repeating steps (b)-(e) until waste has been removed from each portable restroom on the upper floor; and then (g) remotely starting the vacuum system of the sanitation truck; and (h) removing waste from the power booster sub-station's holding tank and directing the waste to the sanitation truck's holding tank.

The present invention also provides a method of remotely controlling the power take-off (PTO) of a sanitation truck, which powers the truck's vacuum system, the method comprising using a mobile device (e.g., a phone, tablet computer, wristwatch, etc.) to open an application/program (e.g., WEMO app), and using the application/program to power on and off the truck's vacuum system.

In an exemplary embodiment, the method further comprises using the application/program to also power on and off fluid pumps of one or more power booster sub-stations.

BRIEF DESCRIPTION OF THE DRAWINGS

The present disclosure may be better understood with reference to the following drawings. Matching reference numerals designate corresponding parts throughout the drawings, and components in the drawings are not necessarily to scale, emphasis instead being placed upon clearly illustrating the principles of the present disclosure.

While exemplary embodiments are disclosed in connection with the drawings, there is no intent to limit the present disclosure to the embodiment or embodiments disclosed herein. On the contrary, the intent is to cover all alternatives, modifications, and equivalents.

Figure 1:
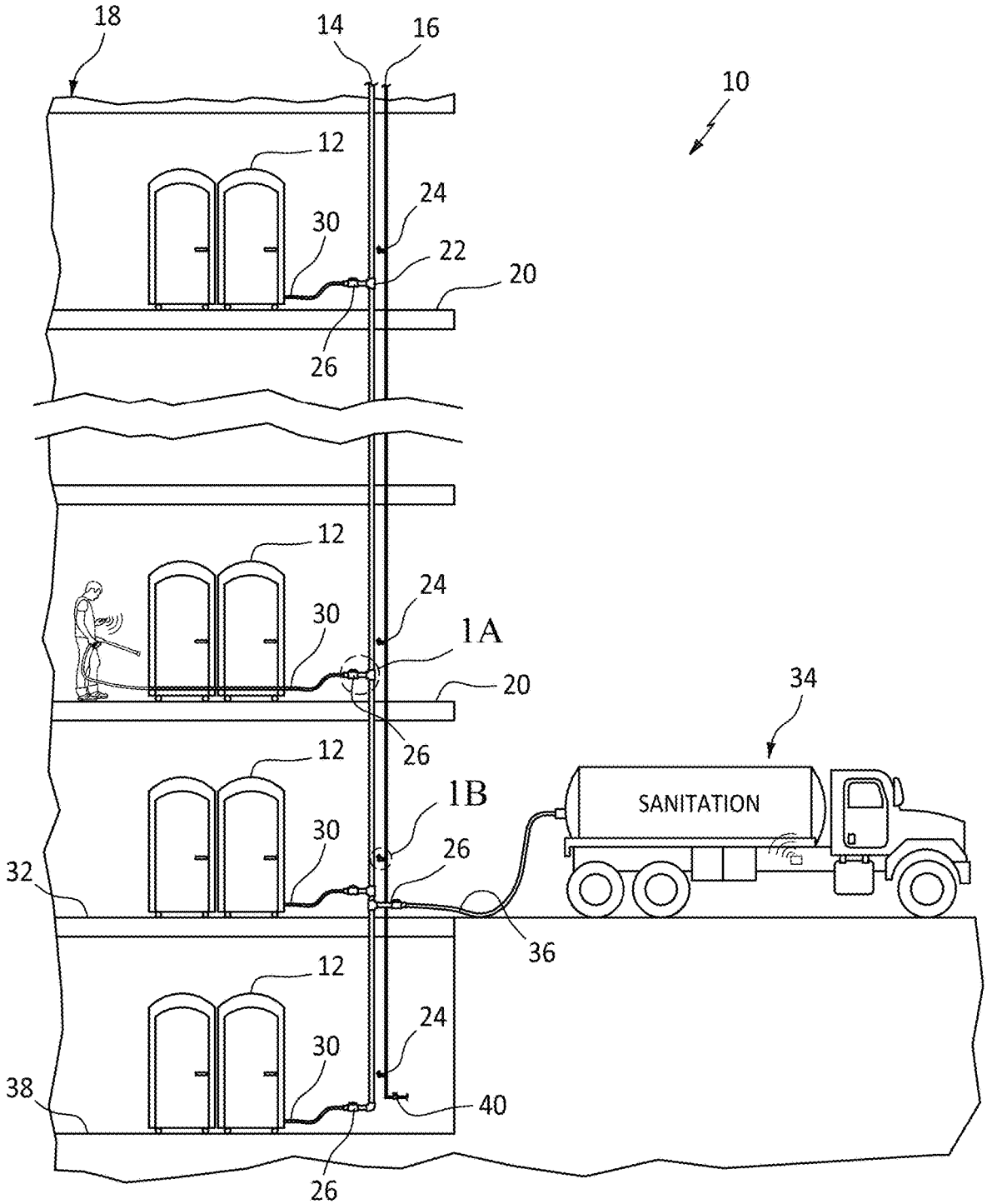
Figure 1A:
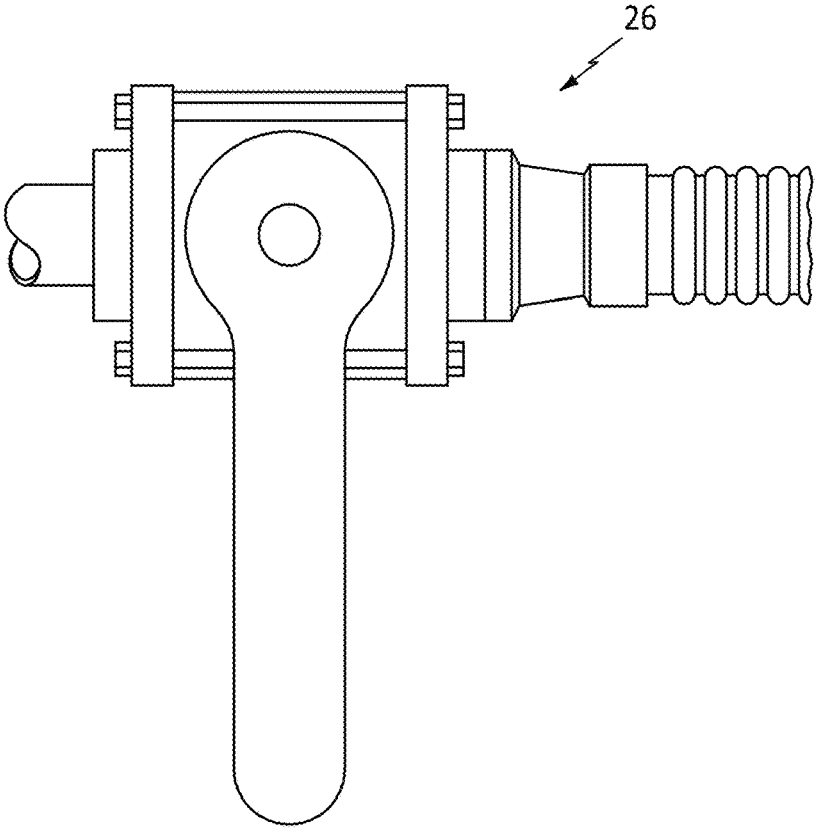
Figure 1B:
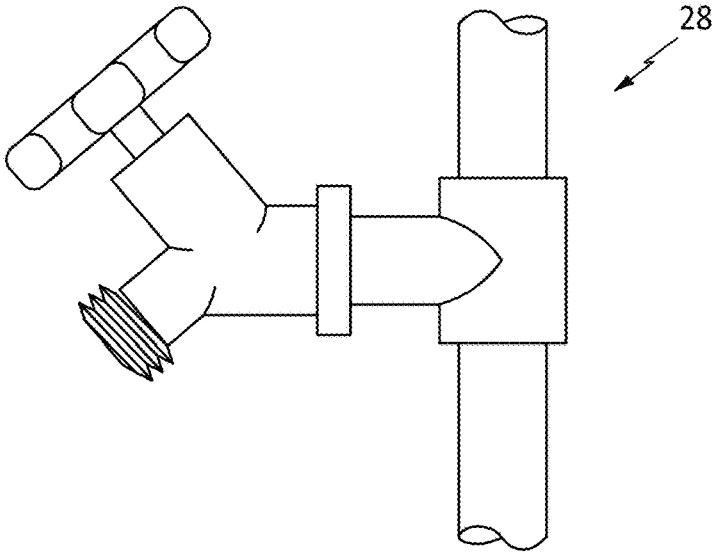
Figure 2:
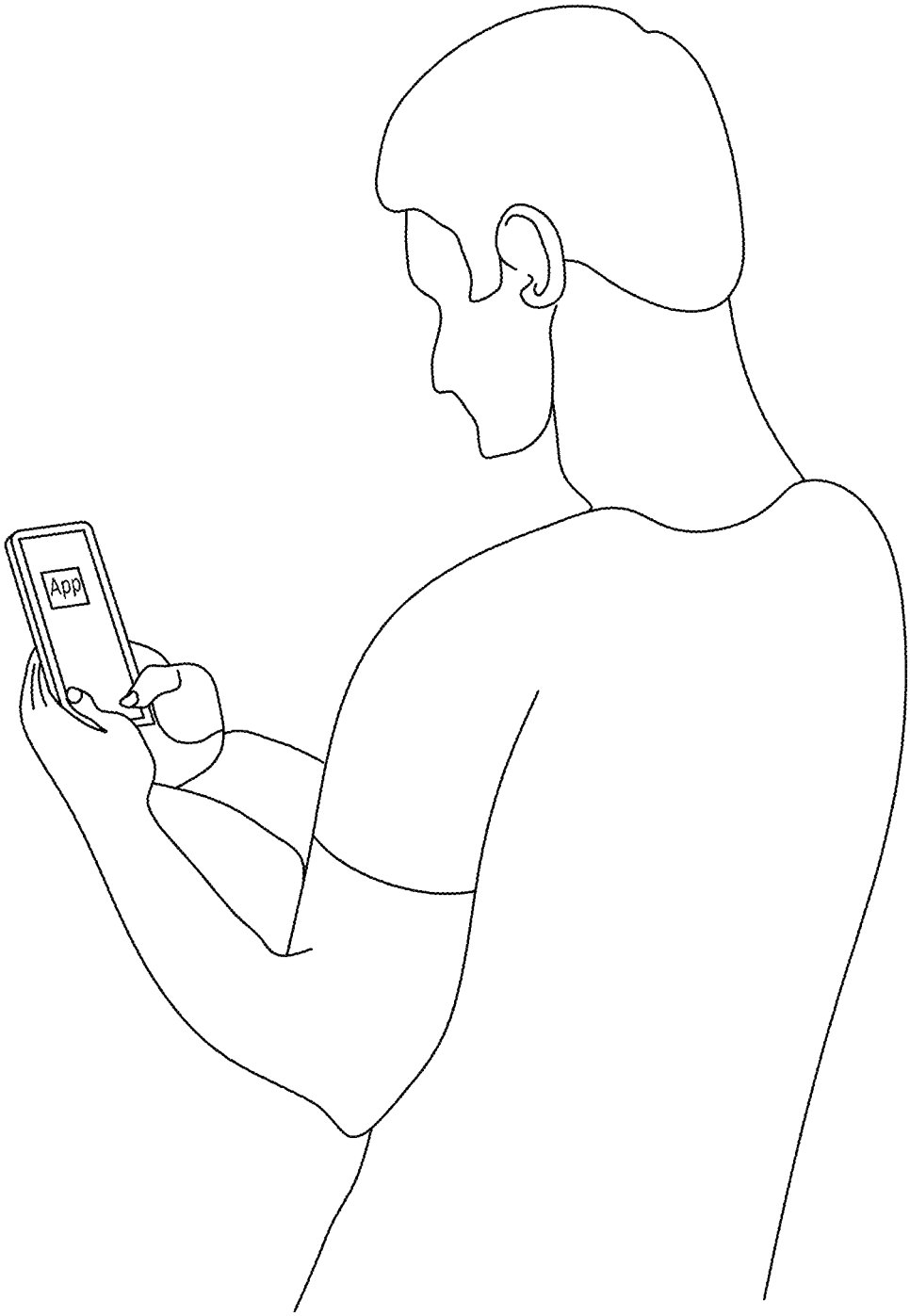

Particular features of the disclosed invention are illustrated by reference to the accompanying drawings in which:

FIG. 1 is a side schematic view of an exemplary embodiment of the portable restroom system of the present invention used in a multilevel building under construction;

FIG. 1A is an expanded view of an encircled portion of FIG. 1, which shows a dump valve assembly;

FIG. 1B is an expanded view of another encircled portion of FIG. 1, which shows a spigot or faucet; and FIG. 2 is a schematic side view of a person using an app on a mobile phone to remotely activate one or more controllers that control the PTO of a sanitation truck.

DETAILED DESCRIPTION OF THE INVENTION

As noted above, the present disclosure presents a portable restroom system for use in a multilevel building under construction, which comprises:

a plurality of portable restrooms; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection (e.g., fittings such dump valve assemblies such as a ball valve/dump valve and water line spigots or faucets) located on each level or floor of the building with one or more portable restrooms, wherein the pipe also has a plumbing connection on a ground or lower floor level of the building allowing for fluid access to a vacuum system of a sanitation truck having a power take-off device (PTO), wherein the vacuum system is powered by the truck's PTO.

Where moving a portable restroom above the ground level of a building under construction can be challenging due to the weight of the portable restroom, the portable restroom for use in the present invention is preferably either equipped with a crane handle, allowing it to be hoisted by a crane, is provided with wheels, or is positioned on a wheeled pallet or dolly, allowing it to be easily moved onto and off a construction or service elevator.

One notable advantage of the present invention is that it allows for the PTO of a sanitation truck (e.g., a transmission-mounted PTO) to be controlled remotely. This allows the truck's vacuum system to be operated intermittently or only as needed, thereby limiting the high levels of noise from the exhaust airflow, which is disruptive to business and/or residential areas located adjacent to the construction site.

In an exemplary embodiment, the PTO of the sanitation truck is controlled remotely by using a mobile device (e.g., a phone, tablet computer, wristwatch, etc.) to open an application/program, and then by using the application/program to power on and off the truck's vacuum system. In a preferred embodiment, the application/program is a WEMO application/program, which is an electrical and electronic controller that is sold for controlling home electric powered devices. In the present invention, this application/program is used to remotely activate electrical and electronic controllers that control the PTO of the sanitation truck.

Referring now to FIG. 1, an exemplary embodiment of the portable restroom system of the present invention is shown generally at 10. System 10 basically comprises: a plurality of portable restrooms 12, each having at least one sanitary fixture (e.g., a toilet, a urinal) (not shown), at least one holding tank (not shown), and optionally, one or more plumbing connections (not shown); and a pipe 14 and a water line 16 that each extend substantially vertically through a multilevel building under construction 18. In this exemplary embodiment, the portable restrooms 12 are located on each level or floor 20 of the building 18, with each portable restroom 12 being in close proximity to both the pipe 14 and the water line 16. The pipe 14 and the water line 16 each have a plumbing connection 22, 24 located on each level or floor 20, with the pipe's plumbing connection being a dump valve assembly 26 (as best shown in FIG. 1A), and with the water line's plumbing connection being a spigot or a faucet 28 (as best shown in FIG. 1B). Flexible hoses 30 are shown attached to each dump valve assembly 26, extending toward the portable restrooms 12. Flexible hoses (not shown) may also be attached to each spigot or faucet 28 extending toward the portable restrooms 12. The pipe 14 also has a dump valve assembly 26 on a ground floor 32 of the building under construction 18, which is shown attached to a sanitation truck 34 via a flexible hose 36, allowing for fluid communication between the pipe 14 and the vacuum system of the sanitation truck 34. The sanitation truck 34 has a PTO, with the vacuum system powered by the truck's PTO. The water line 16 also has a plumbing connection on a lowermost level 38 of the building under construction 18, in the form of a water bleeder valve 40, which will close when the temperature of the water is above a set point and the danger of freezing is over.

Pipe 14 has a preferred inside diameter ranging from about 5 to about 10 centimeters (cm) (more preferred, from about 5 to about 8 cm) and may be made from materials such as stainless steel and iron, fiber reinforced resins, hard polyvinyl chloride, synthetic resins such as polyethylene, polyvinyl chloride (PVC), and rubbers such as styrene-butadiene rubber. In a preferred embodiment, the pipe is made from PVC.

The dump valve assembly 26, which is shown as a manually operated valve with a handle in FIG. 1A, may also constitute a valve that can be operated pneumatically, electropneumatically, electrically, or electromagnetically.

Water line 16 has a preferred inside diameter ranging from about 1.2 to about 5 cm (more preferred, from about 1.6 to about 2.6 cm) and may be made of copper, cast iron, asbestos cement, cement, or plastic materials such as PVC, and cross-linked polyethylene (PEX). In a preferred embodiment, the water line 16 is made from PEX.

Pressurized water may be distributed through water line 16 at pressures ranging from about 0.28 to about 1.03 megapascal (mPa) (more preferred, from about 0.28 to about 0.41 mPa) to the floors 20 in the multilevel building under construction 18. Water may be supplied via gravity feed to the water line 16 by a holding tank located on an upper or top level of the building. Water may also be supplied to the water line 16 by a holding tank with pumping means located on a lower or ground floor of the building, or the holding tank may be located on the sanitation truck. For embodiments in which the holding tank is located on the sanitation truck, the pumping system may be powered by the truck's PTO, which may also be controlled remotely along with the truck's vacuum system.

In areas where temperatures may fall below freezing, instead of or in addition to, for example, a water bleeder valve 40, the water line 16 may be provided with insulation means, and optionally also with a heating mechanism (e.g., heat trace cable, etc.).

The vacuum capabilities (e.g., degree of vertical and horizontal pull) of sanitation truck vacuum systems are dependent upon the elevation or height as well as the overall length and the number of convolutions (e.g., twists and turns) in the piping system through which the vacuum is applied.

Sanitation truck vacuum systems typically have vacuum capabilities of as much as 29 inches of negative pressure. For every change in elevation of a pipe, there is a loss in suction or lift. Further, as the length and number of convolutions in horizontal portions of a piping system increase, there is a corresponding decrease in the degree of pull of the applied vacuum.

For multilevel buildings under construction having more than 10-15 floors, the vacuum system on the sanitation truck alone may not be able to apply sufficient vacuum to the upper floors. The vacuum capabilities of these vacuum systems are further impacted upon by the horizontal hose or pipe length needed to reach portable restrooms on each floor, which increases by, for example, remotely positioning the portable restrooms relative to one another on one or more floors of the building. The vacuum system on the sanitation truck may therefore not be able to apply sufficient vacuum or suction to draw the waste from the portable restrooms into the piping system and then into the sanitation truck's holding tank.

In one exemplary embodiment of the present invention, this problem is addressed using a modified vertical pipe with one or more reduced diameter sections. The reduced diameter section(s) is positioned along a portion of the pipe extending through the upper floors of the multilevel building under construction (e.g., at or above the 10th floor). As will be readily appreciated by those skilled in the art, the use of a reduced diameter section(s), where the vacuum is drawn through a restricted opening, will result in an increase in the suction or lift. In one such embodiment, each section of pipe preferably ranges from about 20 to about 36 centimeters in length and has a preferred inner diameter ranging from about 40 to about 60 percent (%) of the inner diameter of the pipe located on either side of the section.

In another exemplary embodiment, the system includes one or more power booster sub-stations positioned along and in fluid communication with an upper portion of the vertical pipe. Each power booster sub-station is preferably composed of a holding tank and a fluid pump (e.g., a power-boosting pump). The power booster sub-station(s) is preferably positioned along the portion of the vertical pipe extending through the upper floors (e.g., at or above the 10th floor) and serves to draw waste from the portable restrooms positioned on the upper floors and to direct the waste into the sub-station's holding tank. The number of power booster sub-stations and the distance between the sub-stations depends upon the height of the multilevel building as well as the length and number of convolutions in the horizontal piping system on each upper floor. The waste contained in the sub-station's holding tank is emptied into the sanitation truck's holding tank using the sanitation truck's vacuum system. Suitable fluid pumps are available from Pressure Lift Corporation, Lewisville, TX, under the product designation POWER BOOSTER™ pump.

In a preferred embodiment, the fluid pump of the one or more power booster sub-stations is controlled remotely by using a mobile device to open an application/program, and then by using the application/program to power on and off the fluid pump.

In a further exemplary embodiment of the inventive system, a modified vertical pipe with one or more reduced diameter sections is used in combination with one or more power booster sub-stations to achieve a suitable degree of vertical and horizontal pull through the upper floors of the multilevel building under construction.

An exemplary embodiment of the inventive noise-reducing and less labor-intensive method for draining the plurality of portable restrooms 12 in system 10 comprises:

fluidly connecting the vacuum-like flexible hose 36 from the sanitation truck 34 to the pipe's ground-level plumbing connection; and in succession on each floor of the building containing the one or more portable restrooms 12:

(a) opening the pipe's dump valve assembly 26;

(b) fluidly connecting the pipe to a portable restroom;

(c) remotely starting the vacuum system of the sanitation truck 34 (as best shown in FIG. 2);

(d) removing waste from the portable restroom;

(e) remotely stopping the vacuum system of the sanitation truck 34;

(f) repeating steps (b)-(e) until waste has been removed from each portable restroom on the floor; and then (g) closing the pipe's dump valve assembly 26.

A notable advantage of the present invention is that it obviates the need to transport each portable restroom down to a ground level or floor of the building under construction for service (e.g., drainage and cleaning/sanitizing), which saves both time and labor.

In an exemplary embodiment, pipe 14 is fluidly connected to the one or more portable restrooms 12 by way of a vacuum-like flexible hose having a first end connected to the pipe's plumbing connection, and a second end either fitted with a vacuum wand or connected to the portable restroom's plumbing connection. The vacuum-like flexible hoses may optionally be provided with valve means.

The inventive method, in a more preferred embodiment, further comprises cleaning the one or more drained portable restrooms.

In one such embodiment, cleaning the one or more drained portable restrooms comprises: using high-pressure water from water line 16 and a biocidal spray to kill bacteria and microbes to clean out the toilet bowl, and refilling the at least one holding tank with fresh water from water line 16 and a chemical deodorizer.

In a further exemplary embodiment, water line 16 is fluidly connected to the one or more portable restrooms 12 by way of a flexible hose having a first end connected to the water line's plumbing connection, and a second end either fitted with a nozzle or connected to the restroom's plumbing connection. The flexible hoses may optionally be provided with valve means.

In yet a further exemplary embodiment, the multilevel building under construction has more than ten floors, and system 10 further comprises one or more power booster sub-stations positioned along and in fluid communication with the substantially vertically extending pipe located at or above the tenth floor, each power booster sub-station composed of a holding tank and a fluid pump, wherein the method further comprises:

in succession on each upper floor of the building containing the one or more portable restrooms:

(a) opening the pipe's plumbing connection;

(b) fluidly connecting the pipe to a portable restroom;

(c) remotely starting the fluid pump of a power booster sub-station;

(d) removing waste from the portable restroom, and directing the waste to the power booster sub-station's holding tank;

(e) remotely stopping the fluid pump of the power booster sub-station;

(f) repeating steps (b)-(e) until waste has been removed from each portable restroom on the upper floor; and then (g) remotely starting the vacuum system of the sanitation truck 34; and (h) removing waste from the power booster sub-station's holding tank and directing the waste to the sanitation truck's holding tank.

Although exemplary embodiments have been shown and described, it will be clear to those of ordinary skill in the art that a number of changes, modifications, or alterations to the invention as described can be made. All such changes, modifications, and alterations should therefore be seen as within the scope of the disclosure.

I claim:

1. A portable restroom system for use in a multilevel building under construction, which comprises:

a plurality of portable restrooms, each having at least one sanitary fixture; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection located on each level or floor of the building with one or more portable restrooms, wherein the pipe also has a plumbing connection on a ground floor of the building allowing for fluid access to a vacuum system of a sanitation truck having a power take-off device, and wherein the vacuum system is powered by the truck's power take-off device, wherein the multilevel building under construction has more than ten floors, and wherein the substantially vertically extending pipe located at or above the tenth floor has at least one of: (a) one or more reduced diameter sections; and (b) one or more power booster sub-stations positioned along and in fluid communication with the pipe.

2. The portable restroom system of claim 1, wherein the one or more power booster sub-stations are each comprised of a holding tank and a fluid pump.

3. The portable restroom system of claim 1, wherein the one or more power booster sub-stations is powered remotely using a mobile device.

4. A noise-reducing and less labor-intensive method for draining a plurality of portable restrooms in a portable restroom system for use in a multilevel building under construction, which includes: a plurality of portable restrooms, each having at least one sanitary fixture; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection located on each level or floor of the building with one or more portable restrooms, wherein the pipe also has a plumbing connection on a ground floor of the building allowing for fluid access to a vacuum system of a sanitation truck having a power take-off device, and wherein the vacuum system is powered by the truck's power take-off device, wherein the method comprises:

fluidly connecting a vacuum-like hose from the sanitation truck to the pipe's ground floor plumbing connection; and in succession on each floor of the building containing the one or more portable restrooms:

(a) opening the pipe's plumbing connection;

(b) fluidly connecting the pipe to a portable restroom;

(c) remotely starting the vacuum system of the sanitation truck;

(d) removing waste from the portable restroom;

(e) remotely stopping the vacuum system of the sanitation truck;

(f) repeating steps (b)-(e) until waste has been removed from each portable restroom on the floor; and then (g) closing the pipe's plumbing connection, wherein the method further comprises cleaning the one or more portable restrooms after waste removal, wherein the at least one sanitary fixture of the plurality of portable restrooms includes a toilet with a toilet bowl, at least one holding or septic tank, and optionally, one or more plumbing connections, wherein cleaning the one or more portable restrooms after waste removal comprises cleaning the toilet bowl using pressurized water from the water line and a biocidal spray to kill bacteria and microbes, and refilling the at least one holding or septic tank with water from the water line, and a chemical deodorizer.

5. The method of claim 4, wherein pressurized water for cleaning is supplied to the water line by a holding tank located on an upper or top level of the building under construction, by a holding tank with pumping means located on a lower or ground floor of the building under construction, or by a holding tank with pumping means located on the sanitation truck.

6. The method of claim 5, wherein water is supplied to the water line by a holding tank with pumping means located on the sanitation truck, wherein the pumping means is also powered by the sanitation truck's power take-off device.

7. The method of claim 6, wherein the pumping means is started and stopped remotely using a mobile device.

8. The method of claim 7, wherein the mobile device runs a mobile application capable of remotely activating electrical and electronic controllers that control the power take-off of the sanitation truck.

9. A noise-reducing and less labor-intensive method for draining a plurality of portable restrooms in a portable restroom system for use in a multilevel building under construction, which includes: a plurality of portable restrooms, each having at least one sanitary fixture; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection located on each level or floor of the building with one or more portable restrooms, wherein the pipe also has a plumbing connection on a ground floor of the building allowing for fluid access to a vacuum system of a sanitation truck having a power take-off device, and wherein the vacuum system is powered by the truck's power take-off device, wherein the method comprises:

fluidly connecting a vacuum-like hose from the sanitation truck to the pipe's ground floor plumbing connection; and in succession on each floor of the building containing the one or more portable restrooms:

(a) opening the pipe's plumbing connection;

(b) fluidly connecting the pipe to a portable restroom;

(c) remotely starting the vacuum system of the sanitation truck;

(d) removing waste from the portable restroom;

(e) remotely stopping the vacuum system of the sanitation truck;

(f) repeating steps (b)-(e) until waste has been removed from each portable restroom on the floor; and then (g) closing the pipe's plumbing connection, wherein the system further includes one or more power booster sub-stations positioned along and in fluid communication with an upper portion of the substantially vertically extending pipe, each power booster sub-station composed of a holding tank and a fluid pump, wherein the method further comprises:

in succession on each upper floor of the building containing the one or more portable restrooms:

(a) opening the pipe's plumbing connection;

(b) fluidly connecting the pipe to a portable restroom;

(c) remotely starting the fluid pump of a power booster sub-station;

(d) removing waste from the portable restroom, and directing the waste to the power booster sub-station's holding tank;

(e) remotely stopping the fluid pump of the power booster sub-station;

(f) repeating steps (b)-(e) until waste has been removed from each portable restroom on the upper floor; and then (g) remotely starting the vacuum system of the sanitation truck; and (h) removing waste from the power booster sub-station's holding tank and directing the waste to the sanitation truck's holding tank.

10. A portable restroom system for use in a multilevel building under construction, which comprises:

a plurality of portable restrooms, each having at least one sanitary fixture; and a pipe and a water line that each extend substantially vertically through the multilevel building, wherein a first portable restroom is located on one level or floor of the building, and a second portable restroom is located on another level or floor of the building, wherein the pipe and the water line each have a plumbing connection located on each level or floor of the building with one or more portable restrooms, wherein the pipe also has a plumbing connection on a ground floor of the building allowing for fluid access to a vacuum system of a sanitation truck having a power take-off device, and wherein the vacuum system is powered by the truck's power take-off device, wherein water is supplied to the water line by a holding tank located on an upper or top level of the building under construction, or by a holding tank with pumping means located on the sanitation truck.

* * * * *